US005127034A

United States Patent [19]

Wright

[11] Patent Number: 5,127,034

[45] Date of Patent: Jun. 30, 1992

[54] SUPPORT SURFACE AND ARTICLES OF FURNITURE INCORPORATING SAME

[76] Inventor: Howard S. Wright, 436 Devon Street West, New Plymouth, New Zealand

[21] Appl. No.: 519,140

[22] Filed: May 4, 1990

[30] Foreign Application Priority Data

May 5, 1989 [NZ] New Zealand ..... 229015

[51] Int. Cl.[5] ..... A61G 7/005; A61G 7/00

[52] U.S. Cl. ..... 378/209; 5/68; 5/60; 5/601

[58] Field of Search ..... 5/60, 66-69, 5/465; 269/322-326, 328; 378/209, 208

[56] References Cited

U.S. PATENT DOCUMENTS 2,860,937 11/1958 Einstein et al. ..... 5/465
4,545,571 10/1985 Chambron ..... 378/209

FOREIGN PATENT DOCUMENTS 2938261 4/1981 Fed. Rep. of Germany ..... 378/209
0236633 11/1985 Japan ..... 378/209

*Primary Examiner*—Alexander Grosz
*Attorney, Agent, or Firm*—Oblon, Spivak, McClelland, Maier & Neustadt

[57] ABSTRACT

There is disclosed a support surface which is particularly suited for supporting a patient and permitting X-rays of the patient to be taken. The support surface comprises at least two substantially rigid support elements coupled together by a flexible joining element such that relative movement between the support elements can take place. The support elements and flexible joining elements are radio-lucent with at least an area through which X-rays are (in use of a support surface) to pass, being of such relative thicknesses and composition that said area is of substantially uniform radiolucence.

15 Claims, 8 Drawing Sheets

Figure 1:
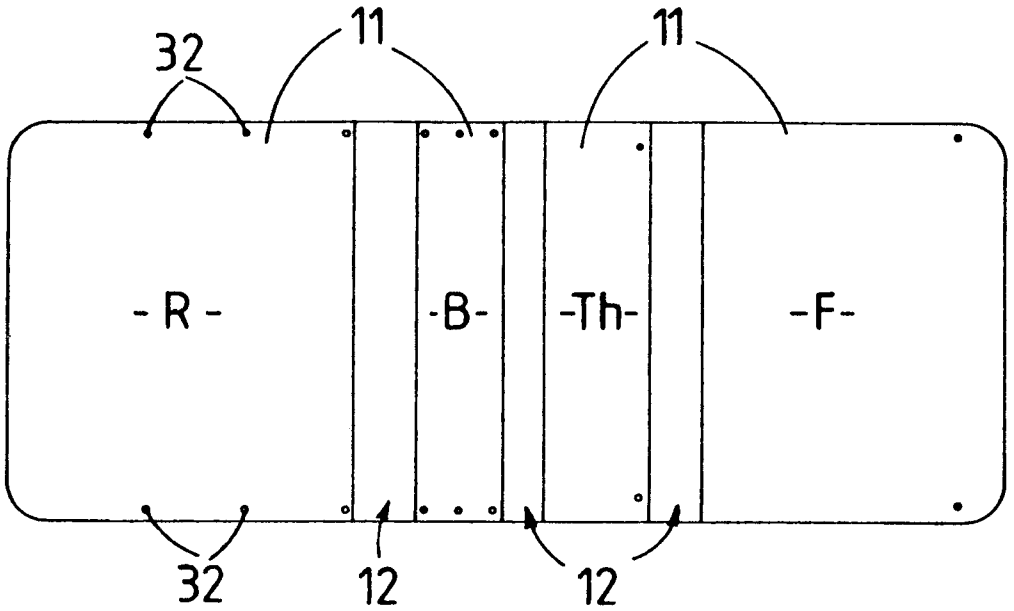

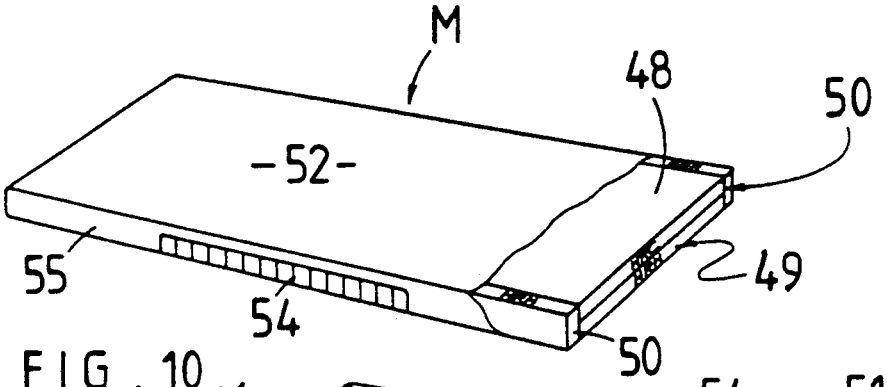
FIG. 10.
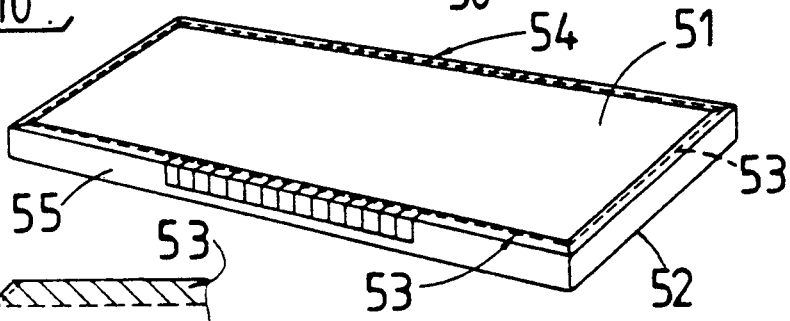
FIG. 11.
FIG. 12B
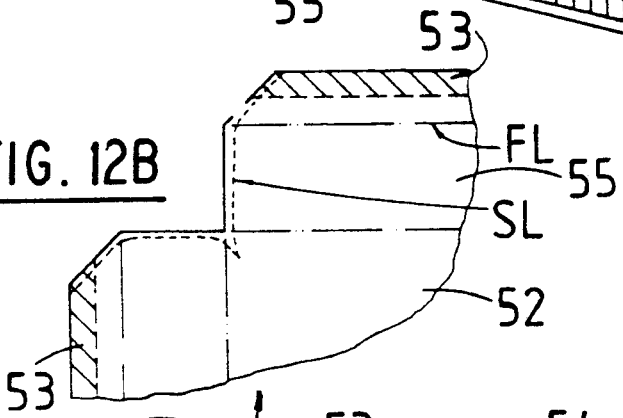
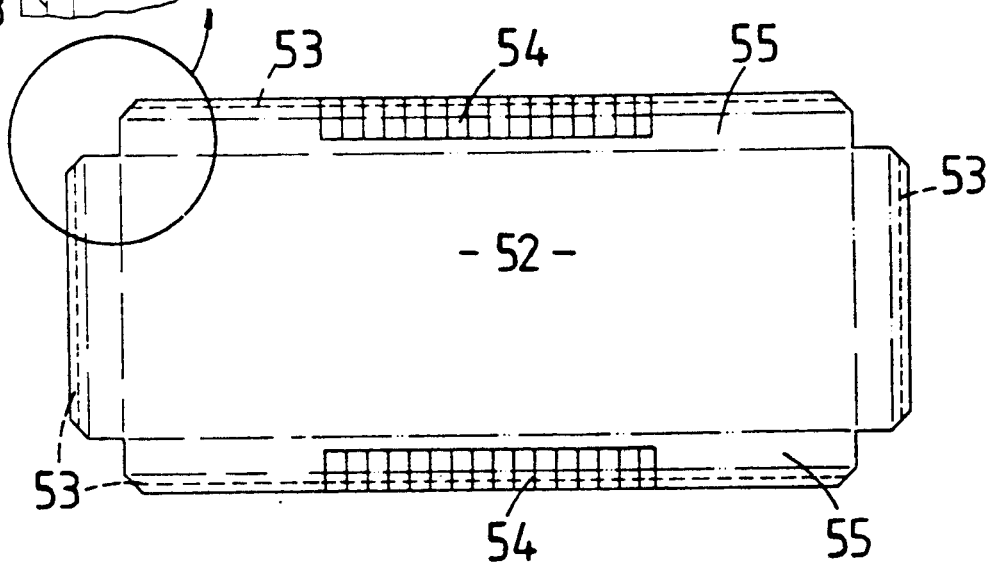
FIG. 12A

SUPPORT SURFACE AND ARTICLES OF FURNITURE INCORPORATING SAME invention relates to a support surface and articles furniture incorporating same.

The support surface to which this invention is primarily directed is designed to provide support for the human form. The support surface is usually intended to be incorporated in an article of furniture such as a lounger, a bed or other form of furniture which provides a support frame whereby the support surface can be mounted and supported.

Such support surfaces can be adjustable from being a flat surface to one which ranges from simply providing a back rest for a person having his or her back in substantially an upright position relative to the lower body or a more complex contoured chair shape which forms not only a back rest but also support for the buttocks and upper legs of the person. The simple back rest or more complex chair contour shape is often formed by one or more movable panels or segments which are mechanically hinged together and can be articulated to the required shape. As such the hinged sections result in a sharp or angular transition between the segments with the result that the support surface does not closely follow the natural contours of the human form. This can lead to discomfort for the user or to the user having to adopt an incorrect sitting/reclining position in order to obtain comfort. This can lead to significant problems when the support surface is incorporated in a bed which is used long term by a user e.g. a hospital or invalid's bed.

The primary object of the present invention is thus to provide a support surface which is adaptable to form support for a person who is reclining or sitting up the construction of the support surface being such that it conforms more closely with the human form when reclining or sitting than has hitherto been the case with adjustable support surfaces.

Broadly the present invention provides in one aspect a support surface comprising at least two substantially rigid support elements coupled together by a flexible joining element such that relative movement between the support elements can take place.

The support surface of the present invention has particular application for use in hospital furniture, patient support surfaces for accident victims and health care furniture in general. Thus for the purposes of description, the following will be more particularly directed to the support surface being used in applications related to such end use.

It is well recognised that when severely injured persons are uplifted from the scene of an accident, their injuries can be aggravated by any further transfer from one piece of equipment to another. For example, this can commonly occur when X-ray pictures need to be taken to make a complete diagnosis. As X-ray equipment is often static within a department and self contained with its own patient support means, such patient transfer is a necessity. It is known to provide mobile X-ray machines which can be used at the bed side. The use of these machines in the intensive care department allows diagnostic X-ray pictures to be taken while other life sustaining procedures are taking place, however, the patient must be lifted to place x-ray cassettes under his/her body and the trolley or bed that the patient occupies must necessarily be compatible with the X-ray machine.

The major requirements of such a trolley or bed are that the patient support surface be radio-lucent and that a space be provided directly under this support surface to accommodate X-ray cassettes. It is therefore common practice to elevate the patient support surface about 30 mm above another surface or a track and sleigh arrangement provided that permits an X-ray cassette to be located anywhere under the patient's body.

The patient support surface of a bed for intensive care use needs to articulate to position the patient correctly for the various procedures necessary. Ideally this surface will have four sections, namely back rest, seat, thigh and leg sections which are adjustable to either provide merely a back rest or a contoured chair configuration.

The secondary object of this invention is thus to provide a patient support surface capable of articulation yet able to maintain a uniform degree of radio-lucence under the patient's body. More particularly, the uniform radio-lucence is provided in at least the area of occupation of the support surface by the patient.

Known patient support surfaces for the purposes of X-ray are usually made of laminated plastic or thin aluminium sheet. The radio-lucence of these materials are different but they fall within a range that is acceptable. When, however, they are segmented to make up the four panels which can be articulated to produce the contoured chair configuration an inherent disadvantage occurs at each point where one panel meets another as uniform radio-lucence is lost.

The common practice is to use material of sufficient thickness to carry the patient's weight and hinge one panel to another each side leaving a working clearance between panels. This working clearance shows on the developed X-ray as an overexposed line. Aluminium of acceptable radio-lucence is too thin to carry a patient's weight so it has to be fixed to a supporting frame which shows up in the X-ray as an underexposed band.

Broadly according to a second aspect of the invention, there is provided a patient support surface comprising at least two substantially rigid elements coupled together by a flexible joining element having such construction that relative movement between the support elements can take place while maintaining substantially uniform radiolucence in at least that area of the support surface normally occupied by a patient's body located thereon.

Figure 2:
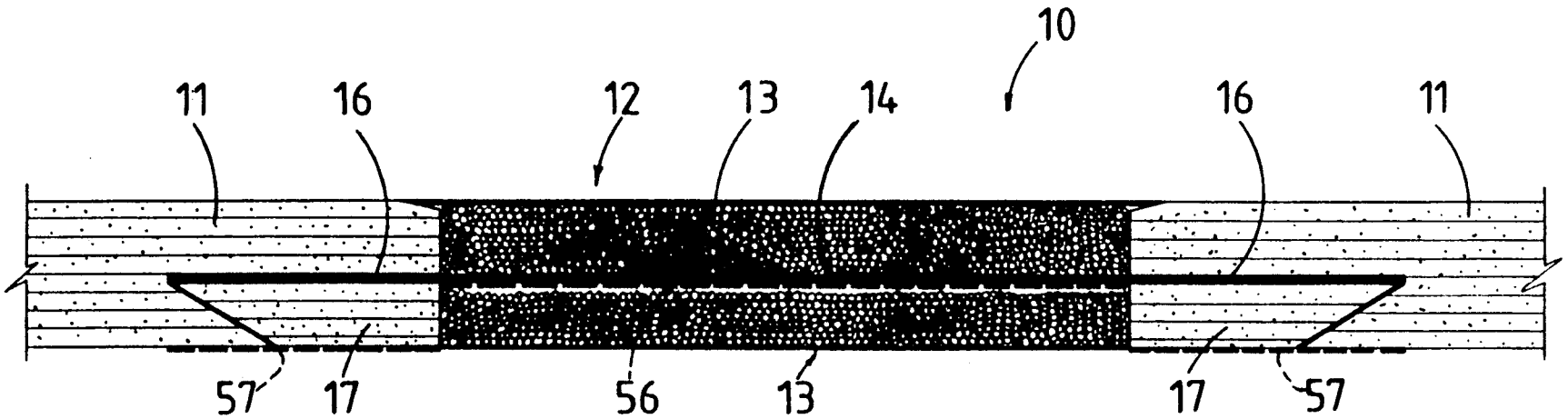
Figure 3:
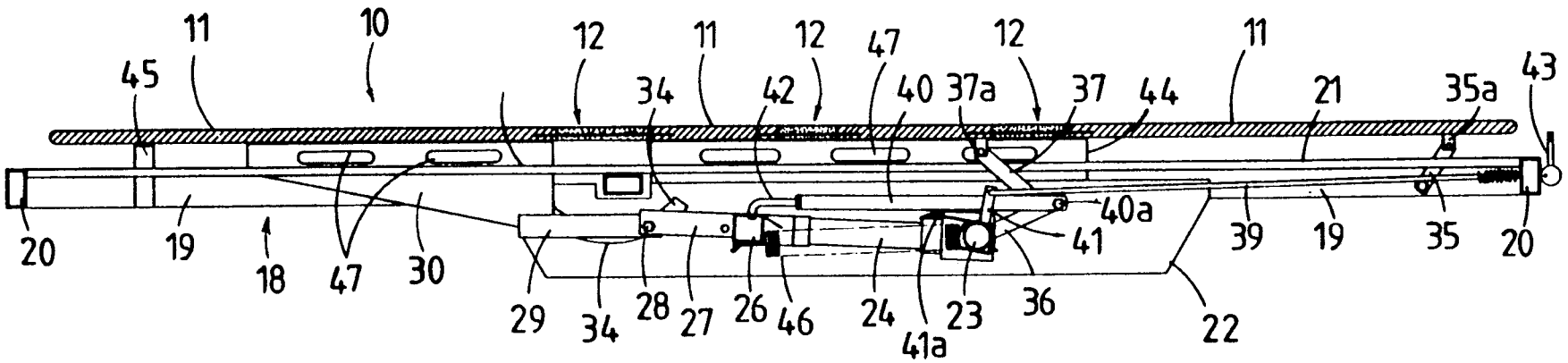
Figure 4:
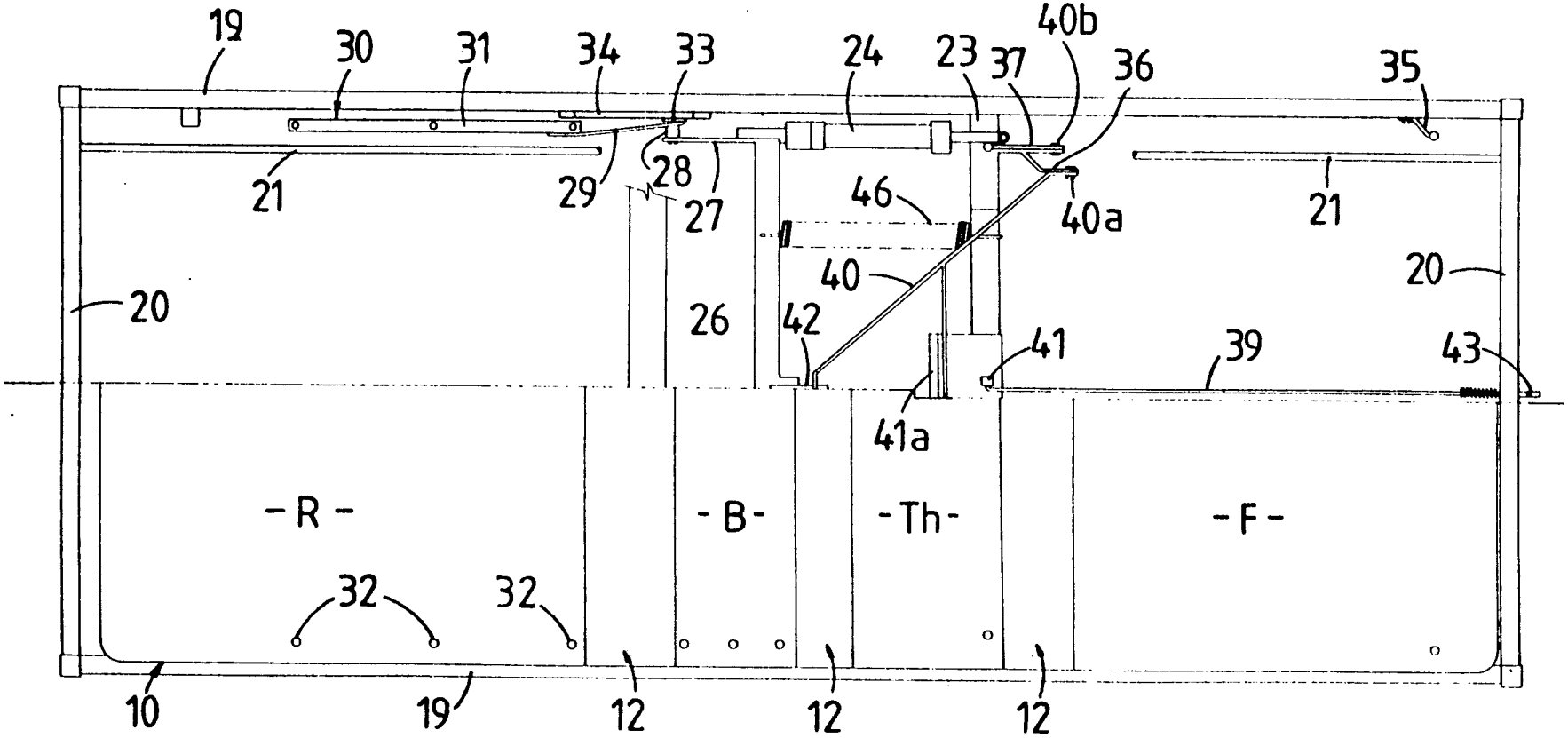
Figure 5:
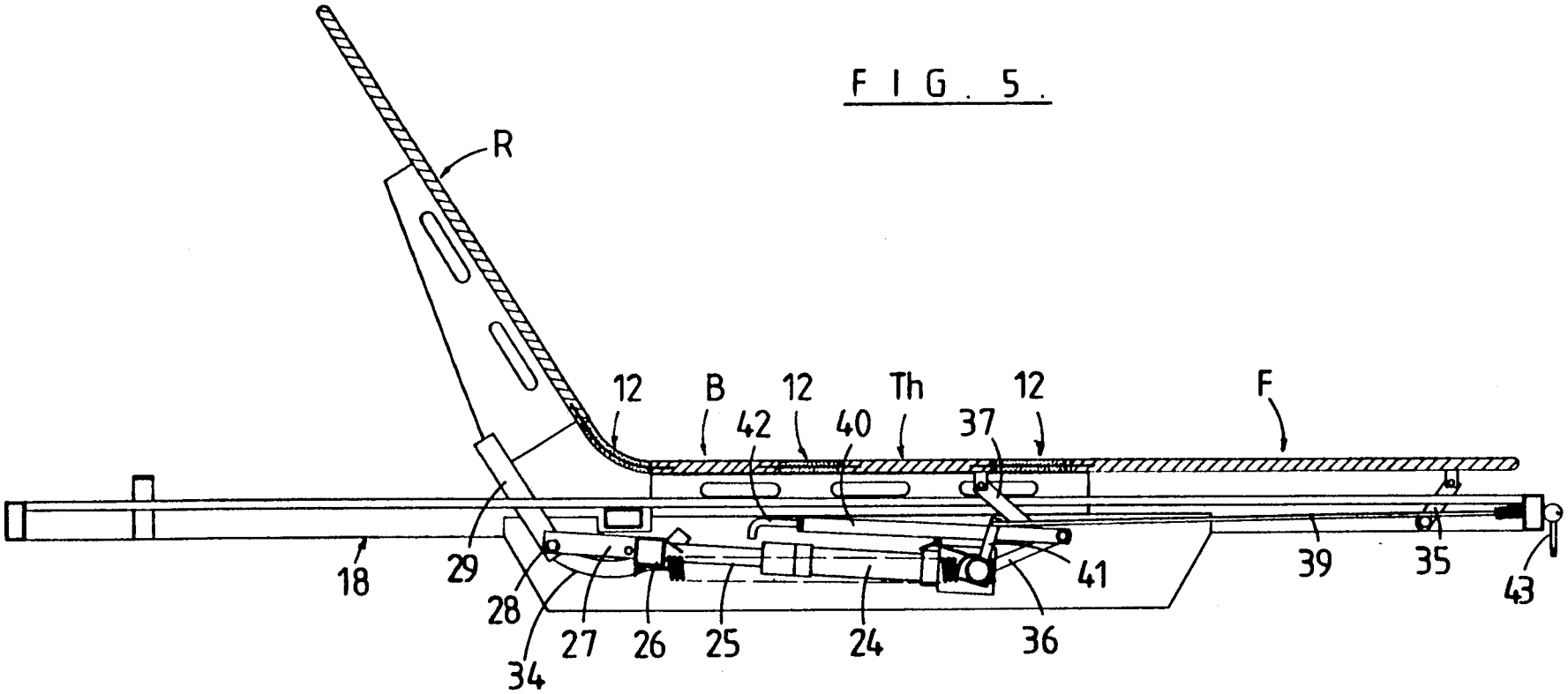
Figure 6:
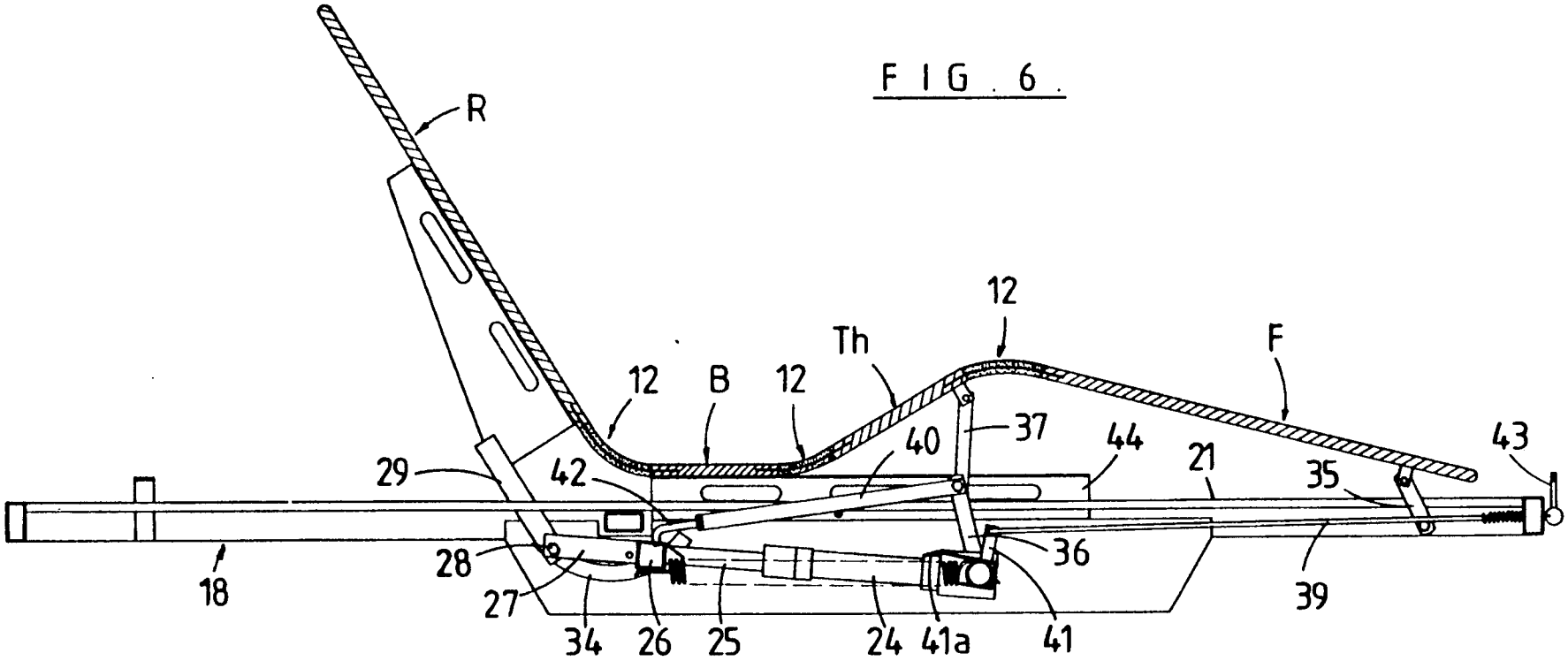
Figure 7:
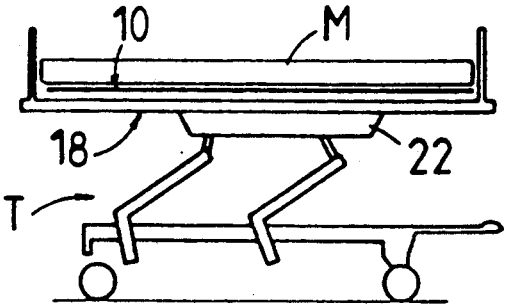
Figure 8:
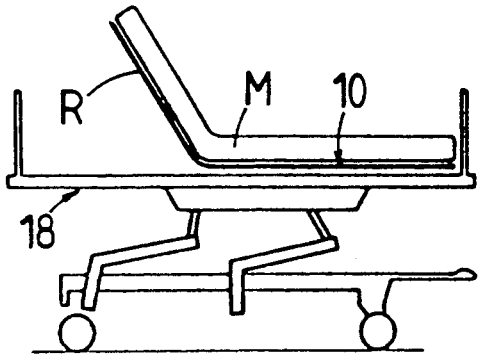
Figure 9:
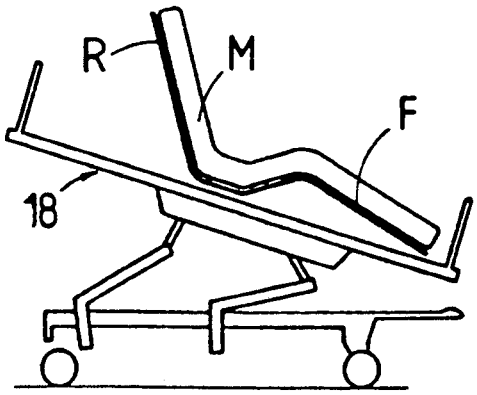

To more fully describe the invention, reference will be made to the accompanying drawings in which:

FIG. 1 is a plan view of the support surface according to a preferred form,

FIG. 2 is a cross-section view through part of the support surface shown in FIG. 1, FIG. 3 is a cross-section view of the support surface located and supported by mounting and control apparatus, FIG. 4 is a plan view of the arrangement shown in FIG. 3 but with the support surface shown in only partial detail, FIGS. 5 and 6 are similar to FIG. 3 but with the support surface having been adjusted to different contours, FIGS. 7 to 9 are schematic views of the arrangement shown in FIGS. 3 to 6 mounted with a mobile trolley, FIG. 10 is a top perspective view of a mattress designed for use with the support surface according to the invention.

FIG. 11 is a bottom perspective view of the mattress shown in FIG. 10, and FIG. 12*a* -*b* is a plan, and detailed view, of the main cover for the mattress shown in FIGS. 10 and 11.

Referring firstly to FIGS. 1 and 2, the support surface 10 comprises a plurality of substantially rigid sections or segments 11 which are, in the preferred form, substantially planar and of substantially constant cross-section or thickness. Segments 11 are coupled in an edge to edge arrangement as shown (so that the top surfaces thereof are substantially aligned to form a planar surface) by flexible joining sections 12. These joining sections 12 comprise one or more (though preferably one) joining member(s) 14 and optionally a filler element or elements 13. Filler element 13 can be used to provide a completely planar and substantially smooth top and if required bottom surface.

Rigid segments 11 are formed of a material which is of a substantially uniform construction and more particularly of substantially uniform radio-lucence. For example segments 11 can be formed from compressed wood fibre board (so called custom wood). This material has the strength relative to its thickness to carry the required loadings and this thickness falls well within acceptable limits for the transmission of X-rays. The material transmits X-rays more readily than say a laminated plastic and aluminium. By way of comparisons 16 mm of compressed wood fibre board has approximately the same suppression or X-ray opacity as 1.0 mm of aluminium. It also has the significant benefit of being a low cost material.

Each segment 11 is connected to the next by an area of material which is thin relative to segment 11. is radiolucent and is capable of bending to the degree required for articulation. A suitable material for joining element 12 is a resin bonded carbon fibre laminate, for instance, carbon fibre cloth bonded with flexible resin to a thickness of 1 mm to 1.5 mm. This flexible material 14 spans between the adjacent rigid segments 11 to create a flexible joint in that one segment 11 can be articulated relative to the next to a varying degree.

The angle to which one segment 11 can be disposed to the adjoining segment is governed by the flexibility of the connecting flexible laminate 14 hence the greater the angle required, the greater the length the flexible section 14 must be. In general terms, for the laminate proposed above, each degree of angle of articulation needed requires 2.0 mm length of flexible element 14.

The flexible element 14 is coupled to the adjacent rigid segments 11 by the arrangement shown in FIG. 2. The opposed edges of the rigid segment 11 are rebated and the edge portion 16 of flexible element 14 is located therein. The portion 17 of the rigid segment removed to form the rebate is then replaced and fastened (say by bonding) in place to fixedly sandwich edge portion 16 in position.

Such a flexible coupling between the rigid panels does not conform to the normal action of a mechanical hinge. It does not pivot from a fixed centre point but rather curves through a diminishing radius as the angle increases.

The use of a flexible material in place of a mechanical hinge in the support surface for a human body has the inherent advantage that where articulation occurs a curved transition is produced rather than an abrupt change of angle. This is more compatible with the human body shape and the various materials used to support it in comfort.

Because the rigid panels 11 are load bearing and the connection 12 between one panel and another is flexible, means have to be provided to carry the forces applied to the support surface 10 irrespective of the angles between the various segments 11. An arrangement for a means of containing these forces is detailed in FIGS. 3 to 6 of the drawings.

As shown in FIGS. 3 to 6, the support and control apparatus for the support surface 10 is formed by a substantially rectangular frame 18 formed of a pair of side members 19 and end cross members 20. Extending between end cross members 20 are a pair of rails 21 on which an X-ray cassette can be located and slidingly moved along the length of the frame and thereby beneath the support surface 10.

Extending downwardly from each side member 19 is a side plate 22. Extending between the side plates is a pivot tube 23 which carries a pair of spaced apart parallel linear actuators (rams) 24, the piston rods 25 of which being attached to a transverse member 26. Extending from or adjacent each end of transverse member 26 is an arm 27 which is pivotally coupled via pivot 28 to a link arm 29 which extends from a support bracket 30.

The support bracket 30 has a flange 31 which engages with the underside of rigid segment 11 and is fastened thereto by mechanical fasteners 32.

Carried at pivot 28 is a follower 33 which is in the preferred form a profiled/shaped block of Nyoil material i.e. a self lubricating nylon material. This follower 33 is engaged in a curved guide 34 mounted by side plate 22.

The segment 11 of the support surface 10 which forms the foot F of the support surface is carried by a pair of arms 35 pivotally coupled at one end to each of the side members 19 and pivotally coupled at the other end to a lug 35*a* extending downwardly from rigid segment 11.

The next adjacent rigid segment 11 carries a lug 37*a* which is pivotally coupled to a link 37 which in turn is pivotally coupled at 40*b* to an arm 36 extending from the pivot tube 23. Coupled at pivot 40*a* is a lever 40 which extends on an angle to transverse member 26 and has a hooked end portion 42 which is able to fit within an opening or aperture in transverse member 26. A control rod 39 extends from a control handle 43 at the foot cross member 20 of frame 18 and this engages with a lever 41 extending from the pivot tube 23. A finger 41*a* extends from and is coupled with lever 41, this finger 41*a* being engagable with a cross piece of lever 40.

With the control handle 43 in the position shown in FIG. 3, the hooked end 42 is engaged in the aperture in transverse member 26. However, by rotating the control handle 43 to the position shown in FIG. 5, lever 41 is pulled rearwardly i.e. toward the foot of frame 18 thus causing finger 41*a* to move upwardly and hence push the lever 40 so that hooked end 42 thereof disengages from transverse member 26. The reason for this arrangement will become apparent from the description which follows.

With the support surface 10 in its flat orientation as shown in FIG. 3, it is further supported by support plates 44 extending upwardly from side members 19 and support posts 45.

To further describe the construction, reference will be made to operation of the control equipment. Referring to FIGS. 3 and 6, operation of the ram 24 (by a suitable pump arrangement of conventional form) causes piston rod 25 to extend thereby moving transverse member 26 longitudinal of the frame 18. As a consequence follower 33 moves along the curved guide 34 and this causes the rigid segment 11 forming the back rest portion R of the support surface 10 to move upwardly as shown in FIG. 6. This movement of the back rest R is achieved by the flexible joining section 12 flexing to adopt a curved profile as shown. The curvature of this joining section 12 is controlled by the follower 33 moving along the suitably profiled guide 34. It will be appreciated that the extent of elevation of the back rest R can be controlled by the extent of extension of the piston rod 25. Throughout its whole range of possible positions, the back rest R is fully controlled and securely supported by the support brackets 30 held and supported by the stabilised arms 27 and link arms 29.

As the transverse member 26 moves, it draws with it arm 40 which as a result of the common pivot 40*a* coupling links 37 and 36 causes the thigh support segment Th to be raised as shown in FIG. 6. Once again the flexible joining sections 12 form smooth curved transitions between buttock segment B and thigh support Th and between thigh support Th and the leg/foot segment F. Foot segment F is able to move in concert with the movement of thigh support Th due to the presence of link 35.

The net result of the articulated movement is a chair configuration having smooth transitions between the various rigid sections thereby resulting in a configuration which more closely follows the human body shape than is possible with known arrangements having mechanical hinges coupling various rigid sections.

A return spring 46 is provided to achieve or assist retraction of the piston rod 25 to thereby return the support surface to the configuration shown in FIG. 3 or any other configuration between the extremes shown in FIGS. 3 and 6.

In the event that only raising of the back rest R is required, control handle 43 can be rotated so as to remove the hooked portion 42 from transverse member 26. Thus as the ram 24 is activated the transverse member 26 is moved thereby resulting in only raising the back rest R (see FIG. 5).

To assist in the manoeuvring of an X-ray cassette on rails 21, there are provided elongate slots 47 in support brackets 30 and support plates 44. The support rods are able to be positioned at the optimum position relative to the underside of the support surface 10 and in addition, due to the control apparatus being largely positioned underneath and outboard of the support rails 21, the area underneath the support surface 10 is entirely clear of obstacles thereby providing for free and easy movement of a X-ray cassette.

The mounting and control apparatus is generally attached to a conventional trolley T as shown in FIGS. 7 to 9. As illustrated in FIG. 9 the support frame 18 can be tilted along with the support surface 10 being configured in the chair shape. As shown in FIG. 9 a patient on the support surface 10 is securely yet comfortably located even in the extremes of adjustment of tilt of the support frame 18 and the chair configuration of support surface 10.

The smooth transition between rigid segments when the support surface 10 is articulated is also beneficial when a mattress M is positioned on the support surface 10 as the mattress more readily adopts the configuration of the support surface 10 than is the case with known hinged support surfaces. However, there is shown in FIGS. 10 to 12 a construction of mattress which is particularly suited for use with the support surface of the present invention. This mattress is also particularly useful when a patient is to be X-rayed without being moved from the bed as its construction is such that it does not adversely effect radio-lucence.

According to this arrangement, the mattress is formed by two single lengths of foam 48 and 49 placed one on top of the other. Preferably the lower length of foam 49 is less resilient than the upper length 48. Extending along each side and glued thereto are vertically orientated lengths of foam 50 which preferably are less resilient than the upper length 48. A length of cover material 51 (which can, for example, be a vinyl) is located on the underside of the foam and a top cover 52 having side walls 55 is located over the foam and the terminal side portions of walls 55 fastened to the under cover 51. Preferably this is achieved by .the use of Velcro (Registered Trade Mark) strips 53.

To provide a greater degree of flexibility of the mattress M in the region which spans the area between the back rest R and leg/foot support F pleats 54 are formed in the long side walls 55 of top cover 52.

In the detail view of FIG. 12 the fold lines FL and sewing lines SL are shown.

The transmission of X-rays differs from one material to another and opacity increases with thickness. The combination of wood fibre panels and carbon fibre flexible sections therefore requires some adjustment to render the whole support surface or at least the area which is normally occupied by a patient, uniformally radiolucent. Because of its inherent qualities and very thin section, the carbon fibre portion 14 transmits X-rays more readily than the wood fibre panels 11. Accordingly X-ray suppressant material available in liquid form is applied to the carbon fibre portion 14 as a coating 56 to equalise the transmission capabilities of the two materials. This coating 56 can, for example, be sodium diatrizoote which is applied using a controlled application method. In addition, a coating 57 may need to be applied under the join of the carbon fibre material 14 to the rigid section 11 to make up for the thickness of slot cut in the edge of segment 11 to accommodate the carbon fibre sheet 14.

In the arrangement shown in FIG. 2, the X-ray suppressant material coating 56 is applied to the carbon fibre sheet 14, however, it could equally be applied in other ways such as to the surface of the foam filler 13.

A means of applying coatings 56 and 57 is to apply the coating material to one surface of an area of adhesive material (such as vinyl with an adhesive on the reverse surface) and then place the required area of coated adhesive material on sheet 14 and/or segments 11 as the case may be.

The combination of rigid panels 11 of compressed wood fibre, which is a low cost material and the small sections of carbon fibre laminate 14, which is a high cost material, results in an economical end cost thereby enabling the support surface to be not only used for specialist X-ray furniture but also furniture which has application in general hospital use. Accordingly a patient does not need to be moved from the bed for X-rays to be taken.

When economics of cost are of less consideration than the bulk and eight of the support surface, the whole support surface could, in an alternative form, be formed of a carbon fibre laminate with thin but rigid core material, e.g. aluminium sheet, inserted into the laminate to produce the substantially rigid panels 11 coupled by the flexible sections of carbon fibre laminate. Such a support surface would, for example, be suitable for ambulance stretchers where lightweight is important. The stretcher could then be moved directly from the ambulance and the patient retained thereon during X-rays and while other accident/life saving treatment is carried out. In such an ambulance stretcher, the support surface could be made to be slid off the stretcher support frame thus allowing the support surface to be slid under a patient for the patient to be then lifted bodily back onto the trolley.

While the foregoing description has related to the support surface having particular application for hospital/emergency uses, the support surface can equally be used in articles of furniture such as reclining chairs, lounges etc. In such an arrangement, a carbon fibre laminate would not necessarily be used as the joining material but some other less costly material such as spring steel could be used.

What is claimed is:

1. A patient support surface, which comprises:

at least two substantially rigid support elements coupled together by a flexible joining element having such a construction that relative movement between the support elements can take place, and an X-ray suppressant material applied as required to achieve substantially uniform radiolucence in at least that area of the support surface normally occupied by the patient's body located thereon.

2. A support surface as claimed in claim 1, wherein the support elements comprise panels formed from compressed wood fiber board and the joining element comprises an area of flexible material spanning between adjacent edges of said panels.

3. A support surface as claimed in claim 1 or 2 wherein the joining element is bendable in only one direction such that as the angle between the support elements diminishes the joining element curves through a diminishing radius.

4. A support surface as claimed in claim 3 wherein the joining element comprises a resin bonded carbon fiber laminate.

5. A support surface as claimed in claim 4 wherein portions of the area of flexible material are fixedly mounted in said support elements.

6. A support surface as claimed in claim 5 wherein a filler material is provided in the area between adjacent edges of the support elements so as to provide a support surface.

7. A patient support surface, which comprises:

at least two substantially rigid support elements coupled together by a flexible joining element having such construction that relative movement between the support elements can take place while maintaining substantially uniform radiolucence in at least that area of the support surface normally occupied by a patient's body located thereon, wherein said rigid support elements comprise panels formed from compressed wood fiber board and the joining element comprises a resin bonded carbon fiber laminate spanning between adjacent edges of said panels.

8. A support surface as claimed in claim 7, which comprises an X-ray suppressant material applied to at least one of the flexible and support elements for achieving said substantially uniform radiolucence.

9. A support surface as claimed in claim 7 or 8 which comprises a filler material provided in the area between adjacent edges of the support elements so as to provide a continuous surface.

10. A support surface as claimed in claim 1 or 7 which comprises a plurality of said substantially rigid support elements joined by said flexible joining elements to form the patient support surface, said support surface being in combination with a support frame to form a piece of one of emergency and hospital equipment.

11. Emergency or hospital equipment as claimed in claim 10 wherein the support frame comprises means for controlled articulated movement of at least one support element relative to a next adjacent support element about the flexible coupling formed by the flexible element joining said support elements.

12. A patient support surface which comprises:

at least two rigid support elements coupled together by a unitary joining element of less cross-sectional thickness than said support elements and being bendable in one direction to enable relative movement between the rigid support elements to take place, and a support frame with which said support surface is mounted, said support frame being free of any frame elements extending immediately beneath that area of the support surface on which a patient would normally be located, said support surface being of substantially uniform radiolucence in at least said area, such that an X-ray cassette is positionable beneath said support surface and a patient may be X-rayed while located on said support surface.

13. A patient support surface as claimed in claim 12 which comprises X-ray suppressant material applied to at least one of the flexible and support elements for achieving said substantially uniform radiolucence in at least said area of the support surface.

14. A patient support surface as claimed in claim 12 or 13 wherein the support elements comprise panels formed from compressed wood fiber board and the joining element comprises resin bonded carbon fiber laminate with portions of said area of flexible material being fixedly mounted in said panels.

15. A patient support surface as claimed in claim 12 or 13 which comprises rails provided beneath the support surface for the sliding location of an X-ray cassette.

* * * * *